United States Patent [19]

Meinecke

[11] Patent Number: 4,556,453

[45] Date of Patent: Dec. 3, 1985

[54] APPARATUS FOR CLEANING PAPER MAKING MACHINE SCREEN BELTS

[75] Inventor: Albrecht Meinecke, Heidenheim, Fed. Rep. of Germany

[73] Assignee: J. M. Voith GmbH, Heidenheim, Fed. Rep. of Germany

[21] Appl. No.: 634,555

[22] Filed: Jul. 26, 1984

[30] Foreign Application Priority Data

Aug. 6, 1983 [DE] Fed. Rep. of Germany ..... 3328515

[51] Int. Cl.[4] ..... D21F 1/32; D21F 7/00

[52] U.S. Cl. ..... 162/274; 15/256.52; 162/275; 210/396

[58] Field of Search ..... 162/274, 275, 272, 199; 198/496; 210/396; 15/256.52; 134/6

[56] References Cited

U.S. PATENT DOCUMENTS

| | | | |
|---|---|---|---|
| 1,247,736 | 11/1917 | Stockard | 198/496 |
| 1,537,195 | 5/1925 | Salisbury | 162/274 |
| 4,213,794 | 7/1980 | Wooding et al. | 15/256.52 |
| 4,224,166 | 9/1980 | Wyman | 210/396 |
| 4,319,831 | 3/1982 | Matsui et al. | 15/256.52 |

FOREIGN PATENT DOCUMENTS

| | | | |
|---|---|---|---|
| 53316 | 9/1982 | European Pat. Off. . | |
| 13930 | 6/1881 | Fed. Rep. of Germany | 162/274 |

*Primary Examiner*—S. Leon Bashore
*Assistant Examiner*—K. M. Hastings
*Attorney, Agent, or Firm*—Lon H. Romanski

[57] ABSTRACT

An apparatus especially suited for cleaning impurities from plastic screen belts of paper making machines is shown as having a first drum type brush operatively engaging, through its bristles, the screen belt. The bristles are made of material having a high affinity to such impurities. A second drum type brush, of which its bristles are made of material having a low affinity for such impurities, spaced from the screen belt, is in operative engagement with the first drum type brush as to remove the impurities, which the first drum type brush carries because of removal thereof from the screen belt, from the first drum type brush and deposit such impurities into a receiving area.

13 Claims, 2 Drawing Figures

APPARATUS FOR CLEANING PAPER MAKING MACHINE SCREEN BELTS

FIELD OF THE INVENTION

This invention relates generally to a paper making machine and more particularly to apparatus employed for cleaning the belt-like screen or screens of such a paper making machine.

BACKGROUND OF THE INVENTION AND PRIOR ART STATEMENT

In the art of paper making, the machines employed therefor often comprise endless revolving screen-like belts. It has been discovered that the quality of the paper, cardboard or the like, produced by such machines employing endless revolving screen belts is often impaired due to fouling of the screen belts by impurities. This problem has, generally, been realized as by European Patent Application No. 0053316 filed Nov. 14, 1981, and having a Date of Publication of June 9, 1982.

More particularly, because of regulations relating to environmental protection, the paper making machines, at least in the most part, must employ a closed water circulation and dilution cycle. As a result, the relative amount of impurities in the process water, employed in the paper making process, increases and such impurities deposit upon, among other things, the screen belts. Further, there is an increasing use of recovered or used paper in the production of various grades of paper and such used paper often includes a relatively great amount of impurities which are relatively sticky and may comprise, for example, coloring pigments, latex, resins, bitumen, etc. Also, instead of forming the screen belts from metal wire, as for example phosphor bronze wires, there is an increasing trend to forming the screen belts from wires of synthetic (plastic) material such as, for example, polyester.

The use of screen belts comprised of plastic (synthetic) material creates or at least intensifies the problem of deposits of impurities. That is, experience has shown that the impurities within the process water adhere more strongly to screen belts comprised of plastic material than to metallic screen belts.

Said European Patent Application No. 0053316 has proposed various devices in an attempt to successfully clean the deposited impurities from the screen belts. One of the devices proposed by said European Patent Application No. 0053316 comprises a drum type rotary brush situated as to have its axis of rotation transverse of the running direction of the screen belt and positioned as to have the brush portion thereof in continuous contact with screen belt. As illustrated in FIG. 2 of said Application No. 0053316, the drum type rotary brush 9 is located as to always be at the returning portion of the screen belt which is already free of or separated from the paper or fibre web. Said FIG. 2 depicts, in a fragmentary view, a usual Fourdrinier paper making machine in which, as is known in the art, the fibre or paper web is formed on the top side of the upper screen belt section (not shown in said FIG. 2). Below such paper web-forming zone, the section of screen belt is free of the paper web and travels back as generally indicated by the arrow in said FIG. 2, to what may be considered a starting area for the further continuous forming of the paper web. Because of this, the rotary brush 9 in said FIG. 2 is applied to the returning screen belt 1 from below the screen belt. By so doing such impurities as are removed by said rotary brush 9 can fall into the catch basin or trough 4.

One of the disadvantages of the structure disclosed in FIG. 2 of said Application No. 0053316 is that the rotary brush 9 cannot be employed for cleaning a top or upper screen belt of a double-screen type paper making machine or, if so employed, can be employed only with great difficulties. In such situations it becomes necessary to apply said rotary brush 9 against the returning screen belt section from above such returning screen section.

Further, said Application No. 0053316 fails to provide any information, or even a hint, as to the material which could or should be used for the forming of the bristles of the rotary brush 9. This, therefore, makes it doubtful as to whether the said rotary brush 9 is even capable of removing, in sufficient quantities, impurities from the screen belt.

Accordingly, the invention as herein disclosed and described is primarily directed to the solution of such and other related and attendant problems of the prior art as well as to provide apparatus, for cleaning paper making machine screen belts, which is sufficiently effective even if sticky impurities are abundant.

SUMMARY OF THE INVENTION

According to the invention, apparatus for cleaning a paper making machine screen belt comprises first rotary brush means having an axis of rotation transverse to the direction of travel of said screen belt, said rotary brush means operatively engaging said screen belt as to during rotation of said rotary brush means and travel of said screen belt remove impurities carried by said screen belt, and combing means spaced from said screen belt and operatively engaging said rotary brush means, said combing means being effective to comb from said rotary brush means such of said impurities as are carried by said rotary brush means as a consequence of said rotary brush means removing said impurities from said screen belt and thereafter depositing said impurities as are combed into a receiving area other than said screen belt.

Various specific objects, advantages and aspects of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted from one or more views.

DETAILED DESCRIPTION OF THE PREFERRED EMBODIMENT

Figure 1:
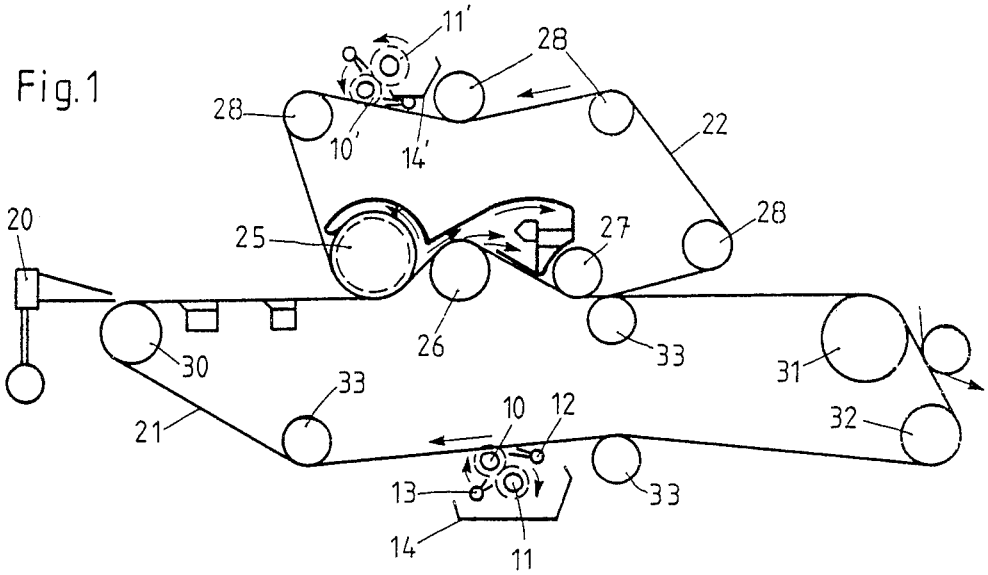
FIG. 1 is a schematic view illustrating a double-screen type paper making machine employing teachings of the invention.

Referring now in greater detail to the drawings, the double-screen type paper making machine of FIG. 1 has, in the usual manner, a breast box 20, a closed loop continuous bottom or lower situated screen belt 21 and a closed loop continuous top or upper situated screen belt 22. The two screens 21 and 22 operatively jointly travel over or against drums or rolls 25, 26 and 27. Additional drums or rolls 28—28 are provided against which only the upper or top screen belt means 22 travels while, similarly, additional drums or roller means 33—33, 31, 32 and 30 are provided for operative rolling coaction against the bottom screen belt means 21.

A first drum type or generally cylindrical rotary brush means 10 is situated below the lower portion or returning section of the bottom screen belt means 21 and positioned as to have the generally radiating bristles thereof applied against the said returning screen belt section from below. Further, rotary brush means 10 is situated as to have its axis of rotation transverse to the direction of travel of said returning screen belt section.

A second drum type or generally cylindrical rotary brush means 11 is situated as to have its axis of rotation transverse to the direction of travel of said returning screen belt section. Further, the axis of rotation of the brush means 11 is situated at an elevation generally below that of the axis of rotation of said brush means 10 and offset to one side thereof so that a line of centers as between the axes of brush means 10 and 11 is generally oblique with respect to the vertical and with respect to said returning screen belt section where operatively contacted by the brush means 10.

As depicted in FIG. 1, the second brush means 11 is spaced as to operatively engage the rotary brush means 10. Preferably such engagement would occur at a relatively lower portion of the rotary brush means 10 as at, for example, in the lower right-hand quadrant of the generally cylindrical rotary brush means 10 as viewed in FIG. 1.

The rotational speeds of the brush means 10 and 11, each of which extend transversely over the total width of the screen belt means 21, are selected so that at the various points of engagement, between the bristles respectively carried by brush means 10 and 11, differential circumferential speeds exist.

In the preferred embodiment, spray-type conduit means or manifold means 12 and 13 are provided and operatively connected to a suitable source (not shown) of liquid, preferably under superatmospheric pressure. In such an embodiment the spray conduits or tubes 12 and 13 would operatively extend transversely of the direction of travel of the returning screen belt section of lower screen belt means 21. The provision of such spray tubes 12 and 13 enables the directing of an added cleaning liquid into the zone of engagement as between the bottom screen belt and the first rotary brush means 10 and/or into the zone of engagement as between the two rotary brushes 10 and 11. A catch basin, trough or conduit means 14 positioned generally below the rotary brush means 11 serves to transfer the impurities removed from the screen belt means 21, as well as any cleaning liquid added by spray tubes 12 and 13, to a suitable collection area (not shown).

In the embodiment of FIG. 1, the direction of travel of the returning section of the lower screen belt means 21 is depicted by the arrow (generally clockwise about roller means 30, 26, 33—33, 31 and 32) and the direction of rotation of rotary brush means both 10 and 11 is also clockwise as viewed in FIG. 1.

Figure 2:
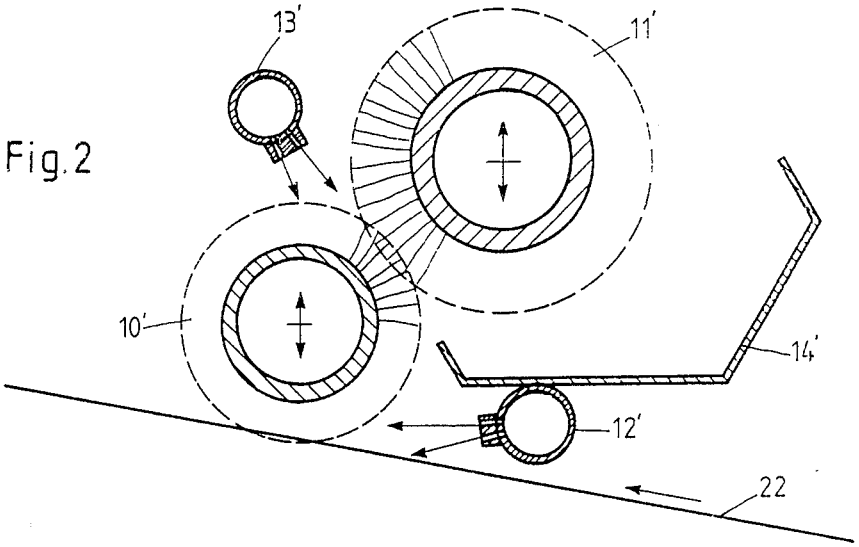
FIG. 2 is an enlarged view of a fragmentary portion of the structure of FIG. 1.

Referring to both FIGS. 1 and 2, a similar cleaning apparatus is arranged and situated generally as at the upper portion of the top or upper screen belt means 22.

As possibly best seen in FIG. 2, a first drum type or generally cylindrical rotary brush means 10' is situated above the returning section of the upper screen belt means 22 and positioned as to have the generally radiating bristles thereof applied, as from above, against the returning section of the upper screen belt means 22. Further, rotary brush means 10' is situated as to have its axis of rotation transverse to the direction of travel of the returning section of the upper screen belt means 22.

A second drum type or generally cylindrical rotary brush means 11' is situated as to have its axis of rotation transverse to the direction of travel of the upper screen belt means 22. Further, the axis of rotation of the rotary brush means 11' is situated at an elevation generally above that of the axis of rotation of the brush means 10' and offset to one side thereof so that a line of centers as between the axes of brush means 10' and 11' is generally oblique with respect to the vertical and with respect to the returning section of screen belt means 22 where operatively engaged by brush means 10'.

As depicted in FIG. 2, the second brush means 11' is spaced as to operatively engage the rotary brush means 10'. Preferably such engagement would occur at a relatively higher portion of the rotary brush means 10' as at, for example, in the upper right-hand quadrant of the generally cylindrical rotary brush means 10' as viewed in either FIGS. 1 or 2.

The rotational speeds of the brush means 10' and 11', each of which extends transversely over the total width of the screen belt means 22, are selected so that at the various points of engagement, between the bristles respectively carried by brush means 10' and 11', differential circumferential speeds exist.

In the preferred embodiment, spray-type conduit means or manifold means 12' and 13' are provided and opertively connected to a suitable source (not shown) of liquid, preferably under superatmospheric pressure. In such an embodiment the spray conduits or tubes 12' and 13' would operatively extend transversely of the direction of travel of the returning screen belt section of upper screen belt means 22. The provision of such spray tubes 12' and 13' enables the directing of an added cleaning liquid into the zone of engagement as between the upper screen belt means 22 and the first rotary brush means 10' and/or into the zone of engagement as between the two rotary brusher 10' to 11'. A catch basin, trough or conduit means 14' positioned generally below the rotary brush means 11' serves to transfer the impurities removed from the screen belt means 22, as well as any cleaning liquid added by spray tubes 12' and 13', to a suitable collection area (not shown).

As also best depicted in FIG. 2, the axes of rotary brushes 10' and 11' (as well as brush means 10 and 11) may be mounted as on any suitable structure in order to be generally vertically selectively displaceable in order to therby be able to selectively vary or adjust the depth of engagement as between the bristles of the first brush means 10' and the screen belt means 22 as well as to selectively vary or adjust the depth of engagement as between rotary brushes 10' and 11'. Such directions of adjustable displacement are depicted as by the arrows in FIG. 2 passing through the axes of rotary brushes 10' and 11'.

Further, as best depicted in FIG. 2, the respective diameters and/or respective bristle lengths of the respective rotary brushes 10' and 11' (as well as those of rotary brushes 10 and 11) may be made different in magnitude thereby, for the same angular velocity, creating a differential peripheral speed therebetween.

In the arrangement of FIG. 2, the upper screen belt means 22 travels in a generally counter-clockwise direction generally about roller means 25, 27 and 28—28 and the brush means 10' and 11' also rotate in a counterclockwise direction as viewed in FIG. 1.

Both brushes 11 and 11', as should now be evident, actually serve as a scraping or combing means with regard to rotary brushes 10 and 10', respectively, That is, for example with reference to FIG. 2, as brush means 10' rotates against the screen belt 22 and picks-up impurities therefrom, such impurities are carried by the bristles of brush means 10' to the zone where the bristles of brush means 11' (traveling as at a different velocity) engage the particles of impurities and in a scraping like or combing like manner dislodge such from the bristles of brush means 10'. Such dislodged impurities are then, in effect, dropped from the bristles of brush means 11' into the receiving means 14'. The same action occurs with regard to brush means 10 and 11.

In addition to the invention as herein already described, it has further been discovered that optimum results are obtained when the bristles of the first brush means 10 or 10' are comprised of a material which exhibits a higher affinity to the sticky impurities than does the material of which the coacting screen belt is made. The apparent problem with this discovery was that the impurities would accumulate on the rotary brush means 10 and/or 10'. This, in turn, led to a further discovery that the impurities thusly removed from the screen belt by the rotary brush means 10 and/or 10' and carried thereby could be removed from the rotary brush means 10 and/or 10' by a scraping or combing action so that the particles of impurities would be effectively removed from the rotating bristles of the brush means 10 and/or 10' prior to such bristles again operatively engaging the associated screen belt. Even though the preferred embodiment of a scraper or combing means is herein disclosed as being a second rotary brush means 11 and/or 11', it is nevertheless contemplated that such scraper or combing means could be a stationary device which at least partially extends into the first brush means 10 and/or 10' as to permit the bristles thereof to pass by and against the fixed scraper or combing means as to thereby dislodge the particles of impurities from the bristles of the brush means 10 and/or 10'.

It has also been discovered that in the use of such scraper or combing means, whether stationary or rotary, best results are obtained when the operative portion of the scraper or combing means, as for example the bristles of the rotary brush means 11 and/or 11', is comprised of material having a relatively low (especially as compared to that of the bristles of brush means 10 and/or 10') affinity to the sticky impurities. As a consequence, the scraper or combing means serves merely to transfer the particles of impurities from the first brush means 10 or 10' (as the case may be) and into a catch means (as for example 14 or 14' as the case may be), thereby assuring that the impurities cannot accumulate either in the brush means 10 or 10' or in the scraper or combing means.

It has also been discovered that excellent results are obtained if the bristles of the brush means 10 and/or 10' are formed of a polyester material, which has a high affinity to sticky impurities while the operative portion of the scraping or combing means is formed of, for example, a silicone compound, teflon or other materials which also have only a slight affinity to the sticky impurities.

Although only a preferred embodiment, and selected modifications of the invention have been disclosed and described, it is apparent that other embodiments and modifications of the invention are possible within the scope of the appended claims.

What is claimed is:

1. Apparatus for cleaning a paper making machine screen belt, comprising first rotary brush means having an axis of rotation transverse to the direction of travel of said screen belt, said first rotary brush means comprising generally outwardly radiating bristles, said bristles of said first rotary brush means operatively engaging said screen belt as to during rotation of said first rotary brush means and travel of said screen belt remove impurities carried by said screen belt, and scraping means spaced from said screen belt and operatively engaging said bristles of said first rotary brush means, said scraping means being effective to scrape from said first rotary brush means such of said impurities as are carried by said bristles of said first rotary brush means as a consequence of said first rotary brush means removing said impurities from said screen belt and thereafter depositing said impurities as are scraped from said bristles of said first rotary brush means into a receiving area other than said screen belt, said scraping means comprising second rotary brush means, wherein said second rotary brush means comprises generally outwardly radiating bristles, wherein said outwardly radiating bristles of said second rotary brush means operatively engage the outwardly radiating bristles of said first rotary brush means, wherein said bristles of said first rotary brush means are comprised of material having an affinity for said impurities carried by said screen belt, and wherein said bristles of said second rotary brush means are comprised of material having an affinity for said impurities which is less than the affinity of said bristles of said first rotary brush means.

2. Apparatus according to claim 1 wherein said bristles of said second rotary brush means are effective to operatively engage by passing generally between said radiating bristles of said first rotary brush means during rotation of said first rotary brush means and thereby dislodge said impurities carried by said bristles of said first rotary brush means.

3. Apparatus according to claim 2 wherein said bristles of said first rotary brush means are comprised of a polyester material, and wherein said bristles of said second rotary brush means are comprised of a silicone compound.

4. Apparatus according to claim 2 wherein said bristles of said second rotary brush means are comprised of teflon, and wherein said bristles of said first rotary brush means are comprised of a polyester material.

5. Apparatus according to claim 1 wherein means are provided so that the peripheral speed of said second rotary brush means is greater than that of said first rotary brush means.

6. Apparatus according to claim 1 wherein means are provided to rotate said first and second rotary brush means in the same direction.

7. Apparatus according to claim 1 wherein means are provided to rotate said first and second rotary brush means in directions opposite to each other, and wherein means are provided so that the peripheral speed of rotation of said second rotary brush means is greater than that of said first rotary brush means.

8. Apparatus according to claim 1 and further comprising means for supplying cleaning liquid into a zone where said first rotary brush means and said second rotary brush means operatively engage each other, said cleaning liquid being so directed into said zone as to result in the bristles of at least one of said rotary brush means carrying a portion of said cleaning liquid between and against the bristles of the other of said rotary brush means.

9. The combination of a paper making machine having at least one traveling continuous screen belt and apparatus for cleaning said screen belt of impurities carried by said screen belt, said apparatus comprising first rotary brush means situated in cooperative relationship to said paper making machine as to have an axis of rotation transverse to the direction of travel of said screen belt, said first rotary brush means comprising generally outwardly radiating bristles, said bristles of said first rotary brush means engaging said screen belt as to during rotation of said first rotary brush means and travel of said screen belt remove impurities carried by said screen belt, and scraping means spaced from said screen belt and operatively engaging said bristles of said first rotary brush means, said scraping means being effective to scrape from said first rotary brush means such of said impurities as are carried by said bristles of said first rotary brush means as a consequence of said first rotary brush means removing said impurities from said screen belt and thereafter depositing said impurities as are scraped from said bristles of said first rotary brush means into a receiving area other than said screen belt, said scraping means comprising second rotary brush means, wherein said second rotary brush means comprises generally outwardly radiating bristles, wherein said outwardly radiating bristles of said second rotary brush means operatively engage the outwardly radiating bristles of said first rotary brush means, wherein said bristles of said first rotary brush means are comprised of polyester material having an affinity for said impurities carried by said screen belt, and wherein said bristles of said second rotary brush means are comprised of material having an affinity for said impurities which is less than the affinity of said bristles of said first rotary brush means.

10. The combination according to claim 9 wherein said paper making machine is of a double-screen type comprising an upper disposed screen belt with a returning section and a lower disposed screen belt with a returning section, wherein said upper disposed screen belt comprises said at least one traveling continuous screen belt, wherein said first rotary brush means is so situated as to cause said bristles of said first rotary brush means to be in operative engagement with said returning section of said at least one traveling continuous screen belt at the top side thereof, wherein said lower screen belt comprises a second traveling continuous screen belt, and additional apparatus for cleaning said second screen belt of impurities carried by said second screen belt, said additional apparatus comprising third rotary brush means situated in cooperative relationship to said paper making machine as to have an axis of rotation transverse to the direction of travel of said second screen belt, said third rotary brush means comprising generally outwardly radiating bristles, said bristles of said third rotary brush means engaging said second screen belt as to during rotation of said third rotary brush means and travel of said second screen belt remove impurities carried by said second screen belt, and second scraping means spaced from said second screen belt and operatively engaging said bristles of said third rotary brush means, said second scraping means being effective to scrape from said third rotary brush means such of said impurities as are carried by said bristles of said third rotary brush means as a consequence of said third rotary brush means removing said impurities from said second screen belt and thereafter depositing said impurities as are scraped from said bristles of said third rotary brush means into a receiving area other than said second screen belt, said second scraping means comprising fourth rotary brush means, wherein said fourth rotary brush means comprises generally outwardly radiating bristles, wherein said outwardly radiating bristles of said fourth rotary brush means operatively engage the outwardly radiating bristles of said third rotary brush means, wherein said bristles of said third rotary brush means are comprised of material having an affinity for said impurities carried by said second screen belt, and wherein said bristles of said fourth rotary brush means are comprised of material having an affinity for said impurities which is less than the affinity of said bristles of said third rotary brush means, wherein said third rotary brush means is so situated as to cause said bristles of said third rotary brush means to be in operative engagement with said returning section of said second traveling continuous screen belt at the lower side thereof.

11. The combination according to claim 9 wherein means are provided to rotate said first and second brush means in the same direction.

12. The combination according to claim 9 wherein said bristles of said second rotary brush means are comprised of teflon material.

13. The combination according to claim 9 wherein said bristles of said second rotary brush means are comprised of a silicone compound.

* * * * *